US008192226B2

(12) United States Patent
Keswani et al.

(10) Patent No.: US 8,192,226 B2
(45) Date of Patent: Jun. 5, 2012

(54) ONE-PIECE CONDUCTIVE CLIP FOR PUSH-IN WIRE CONNECTOR

(75) Inventors: Sushil N. Keswani, Sycamore, IL (US); Gary C. Bethurum, Murrieta, CA (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 12/892,435

(22) Filed: Sep. 28, 2010

(65) Prior Publication Data

US 2011/0076900 A1 Mar. 31, 2011

Related U.S. Application Data

(60) Provisional application No. 61/246,637, filed on Sep. 29, 2009.

(51) Int. Cl.
*H01R 11/20* (2006.01)

(52) U.S. Cl. ..... 439/441; 439/787

(58) Field of Classification Search ..... 439/787, 439/441

See application file for complete search history.

(56) References Cited

U.S. PATENT DOCUMENTS

| | | | | |
|---|---|---|---|---|
| 4,301,438 | A | 11/1981 | McElroy | |
| 4,332,434 | A * | 6/1982 | Neidecker et al. | 439/723 |
| 4,892,488 | A * | 1/1990 | Nestor et al. | 439/438 |
| 6,544,047 | B2 | 4/2003 | Moore | |
| 6,722,914 | B2 | 4/2004 | Blaha | |
| 6,893,286 | B2 | 5/2005 | Drewes et al. | |

OTHER PUBLICATIONS

International Search Report and Written Opinion for PCT/US2010/050583 dated Nov. 22, 2010.

* cited by examiner

*Primary Examiner* — Gary F. Paumen
(74) *Attorney, Agent, or Firm* — Cook Alex Ltd.

(57) ABSTRACT

This is a one-piece conductive clip for use with push-in wire connectors. The one-piece conductive clip retains electrical conductors within the connector and provides electrical connection between two or more conductors. The clip has terminal blocks which include a spring and a busbar. The spring and the busbar are arranged so that the spring clamps a wire inserted between the spring and the busbar. The terminal blocks are arranged in two separate rows where each row is located along a plane generally parallel to the other row. This allows both vertically-stacked and horizontally-adjacent electrical connections between the electrical conductors.

8 Claims, 3 Drawing Sheets

ONE-PIECE CONDUCTIVE CLIP FOR PUSH-IN WIRE CONNECTOR

CROSS REFERENCE TO RELATED APPLICATION

This application claims the benefit of U.S. Provisional Application No. 61/246,637, filed Sep. 29, 2009, which is incorporated herein by reference in its entirety.

FIELD OF THE DISCLOSURE

The present disclosure relates generally to conductive clips, contacts or terminals for use in wire connectors of the type wherein ends of electrical conductors are positioned within the connector for the purpose of making electrical and mechanical connections between the conductors. More specifically, the present disclosure relates to unitary or one-piece conductive clips for use in push-in wire connectors wherein the conductors of stripped ends of electrical wires are pushed into the connector for the purpose of making electrical and mechanical connections between the wires.

BACKGROUND

Push-in wire connectors typically include an insulative plastic housing with a modular metallic conductive clip disposed within the housing. Typically, the modular clip consists of at least two metallic pieces that are mechanically connected to one another. The plastic housing is used to insulate the electrical connection made between the conductive clip and the electrical conductors or wires. The modular conductive clip provides the functions of wire/conductor retention and electrical connection. Specifically, the one portion of the modular clip applies a force against the conductors or wires in order to retain them within the connector and more particularly within the clip once inserted into the housing. In addition, another portion of the modular clip provides an electrical connection between at least two conductors or wires when they are inserted into the connector and more particularly into engagement with the conductive clip.

As mentioned above, conventionally the conductive clip is a modular structure. Typically, the conventional clip consists of at least two separate structures which are mechanically connected to one another. Each of the structures performs only one of the retention or connection functions. For example, the conventional clip includes a spring member and a separate conductive plate or busbar. Typically, the spring and the conductive busbar are separate pieces which are assembled to provide a modular clip that performs the above-mentioned functions.

In addition, each portion of the conductive clip is typically constructed of different materials. For example, the spring member is usually constructed of a material that has good mechanical properties, such as stainless steel, to allow for flexure of the spring member. On the other hand, the busbar is constructed of a material which is a good electrical conductor, such as copper or tin-plated copper, to provide for electrical conductivity within the modular clip. When assembled, the spring member applies force against the wires inserted into the housing by clamping the wires against the busbar and the busbar portion of the clip acts as an electrical short to create an electrical connection between the wires inserted into the housing.

One of the challenges with the modular or two-piece conductive clip is that typically the clip must be pre-assembled before being positioned within the housing. The spring member and busbar are attached to one another by some mechanical means such as riveting, clamping or some other interlocking arrangement. Alternatively, an adhesive may also be used to connect the two pieces. However, regardless of the process, pre-assembly of a modular conductive clip before placement within the housing complicates the manufacturing process of the connector, in part, due to the necessary machinery and manpower required to assemble the modular clip. This additional pre-assembly results in higher manufacturing costs.

Other prior art push-in connectors have attempted to eliminate a step of the pre-assembly of the clip by designing connectors which do not require the spring and busbar to be physically connected to one another but instead are separately fixed with the housing. While this eliminates the pre-assembly of the clip itself, this clip still requires placement of two separate components within the housing. This again complicates the machinery needed to manufacture a connector which ultimately results in higher manufacturing costs.

There are connectors which incorporate a unitary or one-piece conductive clip. Such clips typically perform both functions of retaining the wires within the housing and creating an electrical connection between the wires. For example, such a clip is illustrated in U.S. Pat. No. 4,824,395. This clip includes a first flat base portion, a second upright portion with a plurality of openings aligned in a row, and a third spring portion which folds back toward the first portion to define a cantilevered spring. In use, the electrical wires first extend through the openings of the upright portion when the conductors are positioned within the housing. Once the electrical wires extend through the openings, they interact with the ends of the spring portions to be held in place. The spring portions provide a downward clamping force on the wires in order to retain them within the housing and prevent easy removal.

One of the challenges with such a one-piece conductive clip is that it only accommodates one row of connecting terminals located along the same plane. Although this design is useful when one desires a connector which is capable of connecting relatively few wires, (i.e., three or less), the connector becomes big and bulky when one desires a connector capable of connecting a greater number of wires. Oftentimes, electrical connectors are to be positioned within tight spaces and therefore spatial efficiency is important.

Other unitary or one-piece conductive clips provide busbars with separate landing or support areas for each conductor. For example, such a clip is illustrated in U.S. Pat. No. 6,893,286. The clip has a clamping leg which extends through a window in order to clamp a conductor on the support portions. One of the challenges with such clips is the conductivity issues that arise with the support portions that are each isolated from one another. Another challenge is the ease of accidental removal of a conductor from the clip. In clips that use the isolated supports, typically the clamping leg or spring finger clamps that conductor near the far edge of the isolated support of the bus bar. This configuration allows a user to tilt or otherwise orient the conductor in such a fashion that reduces the angle between the conductor and the spring finger and thereby allows the user to more easily remove a conductor.

Accordingly, there remains a need for a space efficient unitary or one-piece conductive clip which can be easily manufactured and efficiently assembled and is capable of making any number of reliable connections.

SUMMARY

In one aspect, the present disclosure relates to a one-piece conductive clip for electrically connecting at least two conductors of stripped ends of electrical wires. The clip includes a busbar with first and second contact surfaces. A first end wall extends at an angle away from the first contact surface and a second end wall extends at an angle away from the second contact surface. A first spring finger is supported by the first end wall and has a movable clamping end opposed to and directed toward the first contact surface. A second spring finger is supported by the second end wall and has a movable clamping end opposed to and directed toward the second contact surface. A clamping zone is defined between each spring finger clamping end and the opposed respective contact surface. When a conductor is inserted into the clip the conductor engages the spring finger clamping end and opposed respective contact surface and deflects the spring finger toward the end wall.

DETAILED DESCRIPTION

Figure 1:
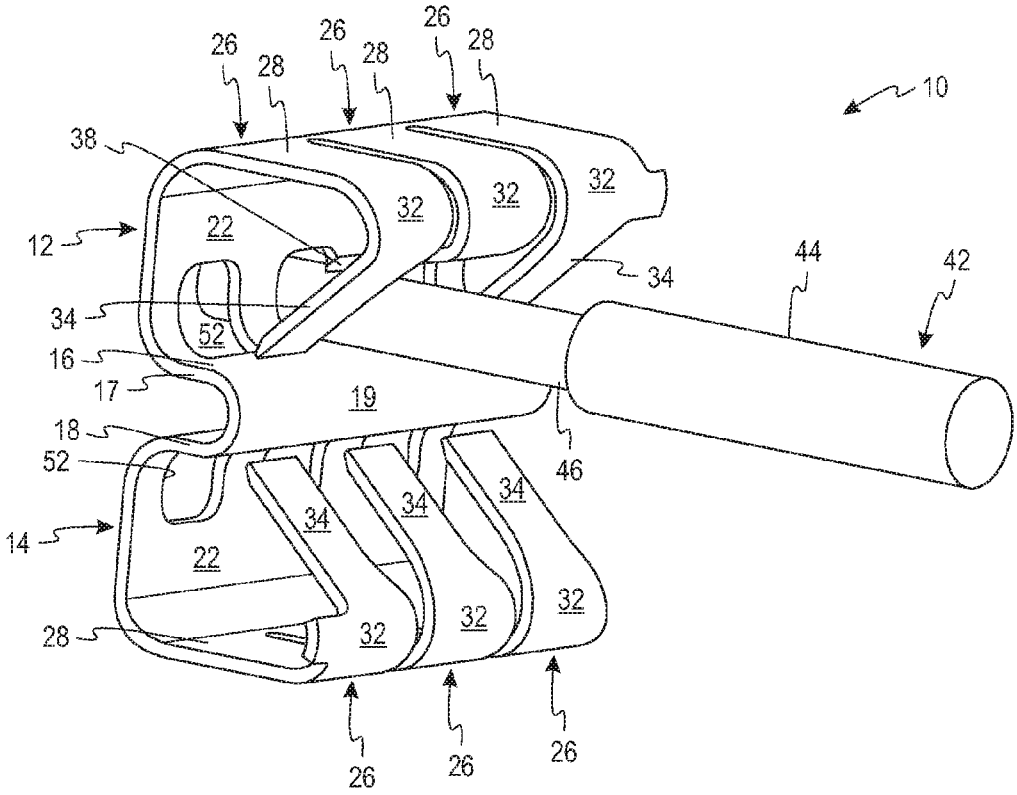
FIG. 1 is a front perspective view of one embodiment of a one-piece conductive clip in accordance with the present disclosure.

As required, detailed embodiments of the present invention are disclosed herein; however, it will be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Disclosed herein are space efficient unitary or one-piece conductive clips, contacts or terminals for use in wire connectors of the type wherein the conductors of stripped ends of electrical wires are positioned within the connector. These one-piece clips are simple to make and do not require any pre-assembly before being positioned within a connector housing because they are unitary. The elimination of pre-assembly reduces the cost of a connector and reduces the steps required to manufacture a connector.

The one-piece conductive clips provide both an electrical connection and a mechanical retainer function. The electrical connection is enhanced by the continuous busbar which allows for high current carrying capacity across the entire busbar. Additionally, the clips of the present disclosure provide two rows of connection terminals along two separate, generally parallel planes. In other words, the conductive clips are designed to have adjacent connection terminals which are stacked in both the horizontal and vertical direction, which results in a more space efficient connector.

Turning to the drawings, FIGS. 1-4 illustrate a first embodiment of a one-piece conductive clip 10 according to the present disclosure. The conductive clip 10 includes first and second terminal blocks 12 and 14, respectively, connected by a busbar 16. In the illustrated embodiments, the terminal blocks 12, 14 are symmetric about a horizontal plane that intersects the middle of the busbar 16. Although the terminal blocks are illustrated as symmetric about a central plane, it is appreciated that the position and size of each of the terminal blocks could be otherwise. For example, it is contemplated that each terminal block could have different dimensions or could have a different number of spring fingers.

In the illustrated embodiment, the busbar is elongated and is generally U-shaped and provides two generally parallel and flat contacts surfaces 17 and 18 joined by a curved connecting portion 19. However, it is appreciated that the shape of the busbar and contact surfaces can be altered without departing from the scope or spirit of the present disclosure. The busbar is continuous in a direction lateral to the axis of inserted wires, i.e., from one port to the next. This provides a much better current-carrying capacity compared to busbars that engage just a single wire and are generally isolated from one another. It also improves the thermal conductivity of the busbar.

In the illustrated embodiment, each terminal block 12, 14 includes an end wall 22 and a series of spring members 26 which extend from the end wall 22. The end walls are connected to the respective contact surfaces 17, 18 and extend at an angle away therefrom. More specifically, they are upright walls that extend at approximately 90 degrees to the contact surfaces. However, it will be appreciated that other angles or configurations can be used.

Figure 3:
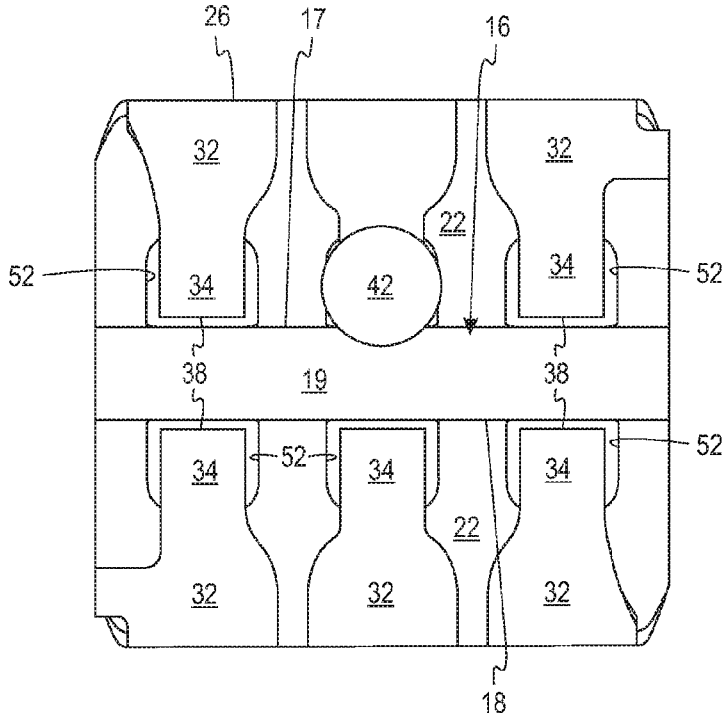
FIG. 3 is a front elevation view of the one-piece conductive clip of FIG. 1.
Figure 4:
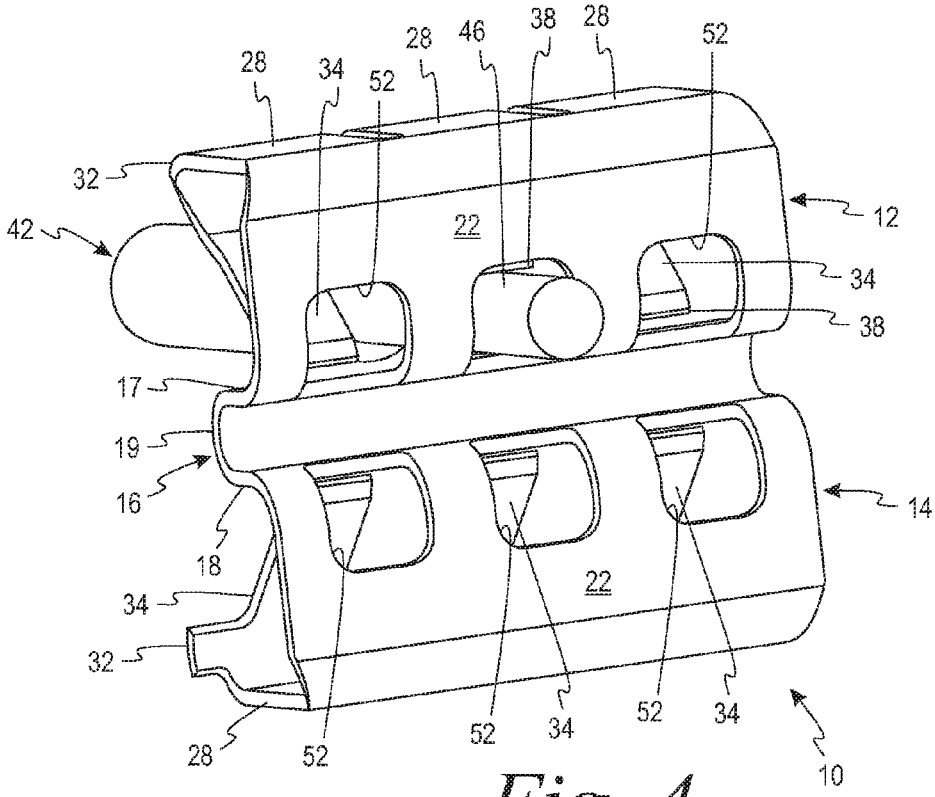
FIG. 4 is a rear perspective view of the one-piece conductive clip of FIG. 1.

Each spring member 26 includes a support leg 28 and a spring finger 34 which are joined by an intervening bight portion 32. The curvature of the bight 32 is such that the spring finger 34 extends at an angle to the respective contact surfaces 17, 18. In a preferred embodiment, the spring finger 34 in its rest or unactuated condition extends at an angle of about 40 to 45 degrees to the contact surface; however, it will be appreciated that other angles can be used. In FIG. 3 it can be seen that the bight 32 and spring finger 34 are necked down to provide a tapered configuration.

Each spring finger 34 may further include clamping ends 38 which oppose the respective contact surface of the busbar. The clamping ends are configured to aid in the retention of a conductor once inserted into the clip. More specifically, the clamping end is configured to dig into an inserted conductor and prevent the removal of the conductor if a user attempts to withdraw the wire. In the illustrated embodiment, the clamping end 38 has an angled biting edge which is coined using conventional processes. Coining work hardens the material to increase its temper and makes it stronger for biting into a conductor.

Together the spring finger clamping end 38 and the opposed contact surface define between them a clamping zone. The clamping zone is the portion of the clip where a conductor is held in place against the contact surface of the busbar by the flexible spring finger 34. Preferably, the contact surface of the busbar within the clamping zone is substantially flat in order to establish a quality electrical connection between the conductor and the busbar.

The spring members 26 are aligned in a row and are each supported from the end wall 22 by the support leg 28 such that the spring finger 34 is spaced from the end wall. In the embodiment illustrated in FIGS. 1-4, the end walls further define openings 52 which are sized and configured to receive the stripped end of an electrical wire or conductor. The openings 52 are aligned with a respective spring member 26 in order to allow easy insertion of the conductor through the clamping zone and then into an opening 52. The openings 52 may be of any suitable shape. For example, the openings of the illustrated embodiment have a generally rectangular shape; however, other suitable shapes would be apparent to one skilled in the art.

Figure 5:
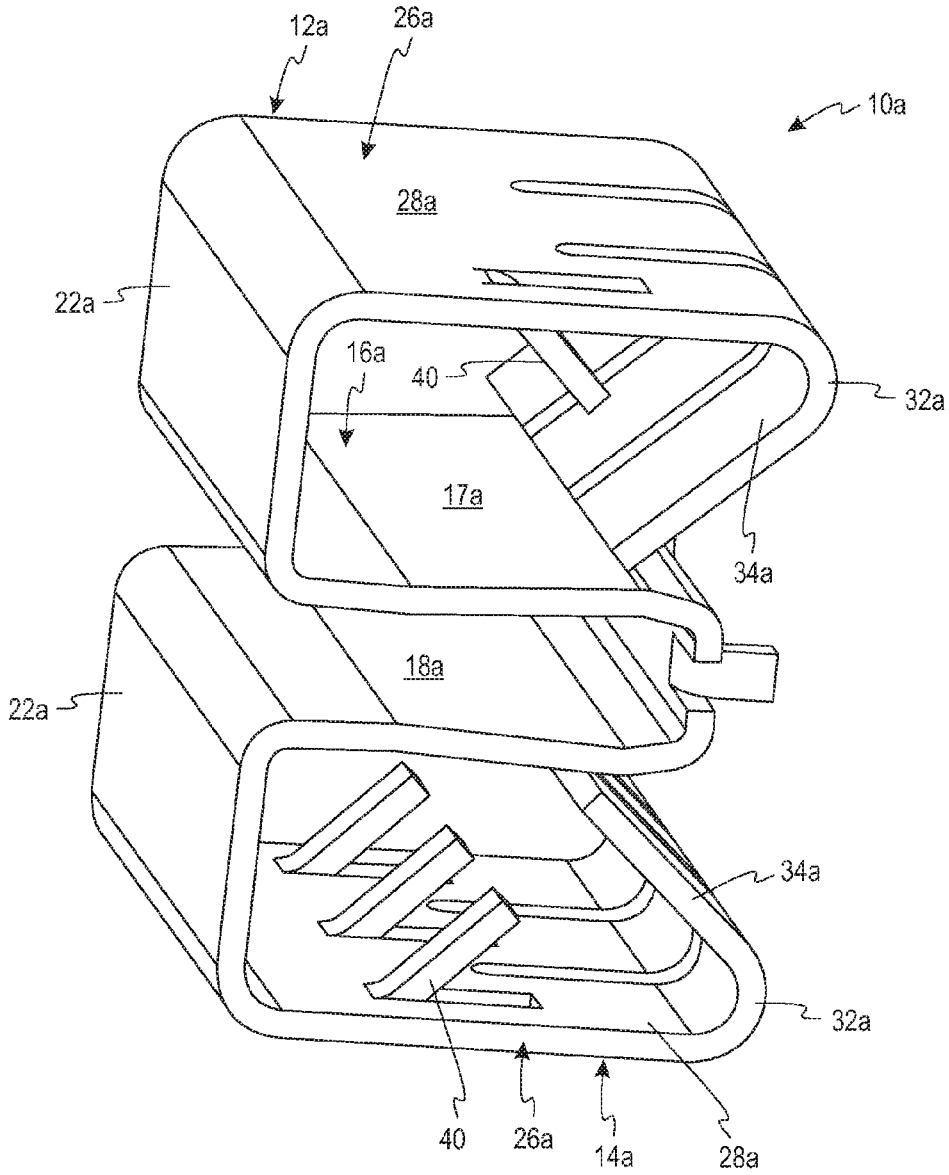
FIG. 5 is a perspective view of another embodiment of a one-piece conductive clip in accordance with the present disclosure.

FIG. 5 illustrates an alternative embodiment of a unitary or one-piece spring clip according to the present disclosure. The clip of FIG. 5 is similar to the clip of FIGS. 1-4. Here the one-piece conductive clip 10*a* is similar to the embodiment of FIGS. 1-4, except the busbar 16*a* and spring support legs 28*a* have been lengthened and the openings in the end walls are omitted.

As shown in FIG. 5, the conductive clip may further include over-stress prevention elements 40. The over-stress prevention elements 40 may be integrally or separately formed in the spring support legs 28*a* by cutting along three sides with the fourth side remaining attached to the spring support leg 28*a*. In the illustrated embodiment the over-stress prevention elements 40 are struck up (for terminal block 14*a*) or down (for terminal block 12*a*) from the spring support legs 28*a*. Each element 40 is generally aligned with the center of a spring member 26*a*. The over-stress elements 40 act as a stop and prevent the spring finger 34*a* from over flexing and permanently deforming, as for example, if one attempted to insert an oversized wire between the spring finger and the busbar. The amount of over-stress prevention can be changed by changing location and/or length of the element 40, although it generally needs to be at about a 90° angle to its associated spring finger 34*a*.

In general, the unitary or one-piece clips of the present disclosure are manufactured out of metal, alloys, or a combination of multiple metals or alloys. Preferably, the metal used is a good electrical conductor and at the same time has the necessary mechanical strength to create a clamping force to retain electrical wires within the connector. Suitable metals include, but are not limited to, steel, copper, nickel, tin, brass, phosphor bronze or the like. In one embodiment, the metal or combination of metals used are described in U.S. Pat. No. 4,824,395 which is hereby incorporated by reference. In another embodiment, the metal used is Alloy 7025 which is developed by Olin Brass. The alloy combines good electrical and thermal conductivity with high strength, and excellent stress relaxation resistance. However, it will be appreciated that the unitary spring clip could be constructed out of other suitable materials.

The one-piece conductive clips of the present disclosure may be manufactured by stamping and/or bending a sheet of metal or metal alloy. In the illustrated embodiments, the spring members 26 and openings 52 are formed by stamping and removing the material. However, it is appreciated that other methods of manufacturing may be employed. For example, the openings 52 may be formed by lancing a portion of the opening and simply bending the material out of the way rather than removing it. This could create a support platform for the inserted wire or conductor.

Once the conductive clip has been bent and stamped into the desired shape, the clip is positioned within a suitable insulated housing (not shown) that is specifically designed to contain the clip. Such housings are typically made out of thermoplastic but also may be made out of any other suitable electrically insulating material. Typically, such housings include openings of some sort for to receive the conductors or wires. These openings are typically in the form of entry ports that guide or direct the electrical conductors into the housing and more specifically into the clamping zone of the clip.

For convenience, the operation of a clip according to the present disclosure will be described in relation to the first terminal block 12 of the embodiment shown in FIGS. 1-4. A wire shown generally at 42 has insulation 44 and a conductor 46. The wire is prepared in the conventional manner by stripping the insulation from the end of the conductor, leaving an exposed or bare stripped end of the wire which is introduced through entry ports of a housing (not shown). The stripped end of the conductor enters the clamping zone and engages the spring finger 34 and more specifically the spring finger's clamping end 38. In the first terminal block 12 the conductor 46 causes the clamping end 38 of the spring finger 34 to deflect upwardly and away from the contact surface 17 and toward the end wall 22. This allows the conductor to be inserted between the end 38 of the spring finger 34 and the contact surface 17. In the case of the second first terminal block 14 the conductor 46 causes the clamping end 38 of the spring finger 34 to deflect downwardly and away from the contact surface 18 and toward the end wall 22. This allows the conductor to be inserted between the end 38 of the spring finger 34 and the contact surface 18. In either terminal block, the conductor deflects the spring finger from its normal rest position. This generates a clamping force which is imparted by the spring finger 34 on the conductor and retains the conductor between the finger 34 and the respective contact surfaces 17 or 18. Any tendency of the conductor to back out of the terminal will be resisted by the spring finger as the end 38 will tend to dig into the conductor in a self-locking action that prevents removal of the conductor. If necessary, the conductor can be further inserted into the connector through the openings 52, if any, in the end wall 22.

Figure 2:
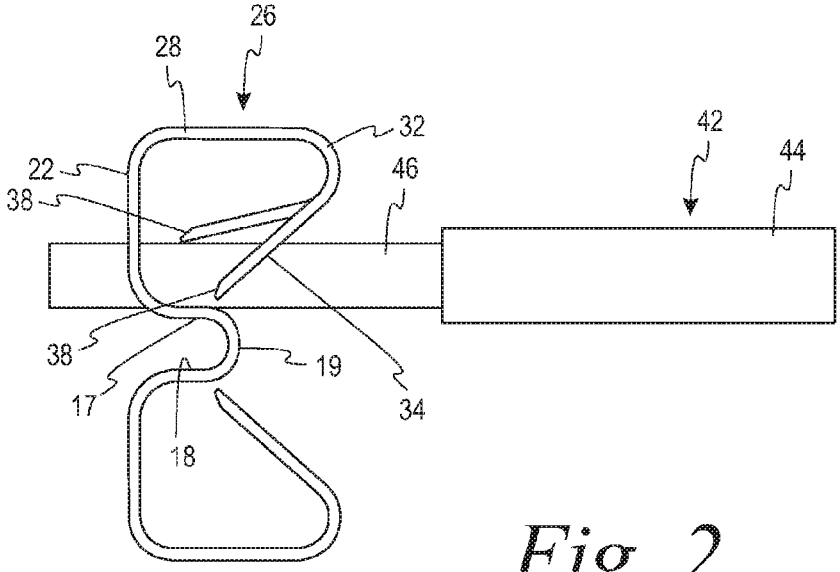
FIG. 2 is side elevation view of the one-piece conductive clip of FIG. 1.

It can be seen in FIG. 2 that the vertical pressure applied by the clamping end 38 of the spring finger on the conductor lies intermediate the front and rear edges of the contact surfaces 17 or 18. Front and rear in this instance refers to the axis of the wire, i.e., the insertion direction of the wire. Thus, the front and rear edges of the contact surfaces are not the lateral edges of the busbar but are the edges that are crossed by an inserted wire. With this arrangement there is support from the busbar for the conductor on either side of the vertical line of force applied by the spring finger. This is advantageous in that such support counteracts any tendency of the wire to tilt or cant about a lateral, horizontal axis. Avoidance of such tilting or canting is preferred because if it were permitted it could result in decreasing the angle formed at the clamping end between the conductor and the spring finger. In other words, such tilting or canting can have the effect of moving the conductor more closely to a parallel condition with the spring finger wherein the holding force of the spring finger is reduced and the conductor can more easily pull out of the clip. The flat surface of the busbar also enhances the electrical contact between the busbar and the conductor.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For example, the conductive clip may also include a disconnect feature which would allow the clamping force of the spring finger on a conductor to be relieved and would allow the user to remove the wire from the clip and ultimately the connector. For these reasons, the scope hereof is not limited to the above description but is as set forth in the following claims, and it is understood that claims may be directed to the features hereof, including as combinations of features that are individually disclosed or claimed herein.

What is claimed is:

1. A one-piece conductive clip for electrically connecting at least two conductors of stripped ends of electrical wires, the clip comprising:

a busbar with first and second contact surfaces;

a first end wall connected to the first contact surface and extending therefrom and a second end wall connected to the second contact surface and extending therefrom;

a first spring finger supported by the first end wall and having a movable clamping end opposed to and directed toward the first contact surface;

a second spring finger supported by the second end wall and having a movable clamping end opposed to and directed toward the second contact surface;

wherein a clamping zone is defined between each spring finger clamping end and the opposed respective contact surface and wherein when a conductor is inserted into the clip the conductor engages the spring finger clamping end and opposed respective contact surface and deflects the spring finger toward the end wall.

2. The one-piece clip of claim 1 wherein each end wall defines at least one opening which is aligned with a clamping zone such that upon insertion of a conductor the opening receives a conductor after it passes through the clamping zone.

3. The one-piece clip of claim 1 wherein the busbar has an elongated U-shape.

4. The one-piece clip of claim 3 wherein the contact surfaces are generally parallel to one another.

5. The one-piece clip of claim 1 further including at least one additional spring finger supported by each end wall.

6. The one-piece clip of claim 5 wherein each end wall supports three spring fingers.

7. The one-piece clip of claim 1 wherein the contact surface within the clamping zone is generally flat.

8. The one-piece clip of claim 1 wherein each spring finger clamping end is coined.

* * * * *